United States Patent [19]

Gugliotti

[11] 4,447,101

[45] May 8, 1984

[54] CONNECTOR WITH REMOVABLE EJECTOR LATCH

[75] Inventor: Carmine Gugliotti, Waterbury, Conn.

[73] Assignee: Litton Systems, Inc., Watertown, Conn.

[21] Appl. No.: 367,412

[22] Filed: Apr. 12, 1982

[51] Int. Cl.[3] ..... H01R 13/635; H01R 13/629

[52] U.S. Cl. ..... 339/45 M

[58] Field of Search ..... 339/45, 46, 75

[56] References Cited

U.S. PATENT DOCUMENTS 4,241,966 12/1980 Gomez ..... 339/45 M

*Primary Examiner*—Neil Abrams

*Attorney, Agent, or Firm*—Brian L. Ribando

[57] ABSTRACT

A locking pivot connection for removable ejector latches for an electrical connector comprises a pair of opposed pivot pins located on each end of the connector. Each pivot pin comprises two opposite flat sides and two opposite curved sides, the thickness of the pivot pin measured between the flat sides being less than the thickness of the pivot pin measured between the curved sides. A pair of circular pivot cups are located on opposite sides of the ejector latch, and a pair of entry slots on opposite sides of the ejector latch join the outer edge of the ejector latch with the pivot cups. The entry slots have a width slightly larger than the thickness of the pivot pin measured between the flat sides of the pivot pin to allow the ejector latch to be slid onto the pivot pins in a direction generally parallel to the plane of the flat sides of the pivot pins. The ejector latch may be locked onto the pivot pins by rotating the latch to skew the entry slots relative to the flat sides.

5 Claims, 4 Drawing Figures

CONNECTOR WITH REMOVABLE EJECTOR LATCH

BACKGROUND OF THE INVENTION

Electrical connectors having ejector latches are well known in the art. The ejector latch in one position holds the socket portion of a connector in engagement with the pins located in the pin cup portion of the connector. The latches may be rocked on pivots to cause an ejector foot on the lower portion of the latch to lift the socket from engagement with the pins. Prior art ejector latches are nonremovably attached to the pin cup portion of the connector, and this may be undesirable when subjecting the connector to a wave soldering operation where the heat from the solder may adversely effect the ejector latches causing the latches to distort. Also, if a user initially does not wish to use ejector latches in the connectors, but desires to add such latches at a later date to prevent separation of the connector halves due to environmental conditions such as vibration, the entire connector must be replaced since prior art latches are not able to be added at such subsequent time.

OBJECTS OF THE INVENTION

It is therefore an object of the invention to provide an ejector latch which may be added to or removed from an electrical connector as desired.

It is another object of the invention to provide a locking pivot connection for such a removable ejector latch.

DESCRIPTION OF THE PREFERRED EMBODIMENT

Figure 1:
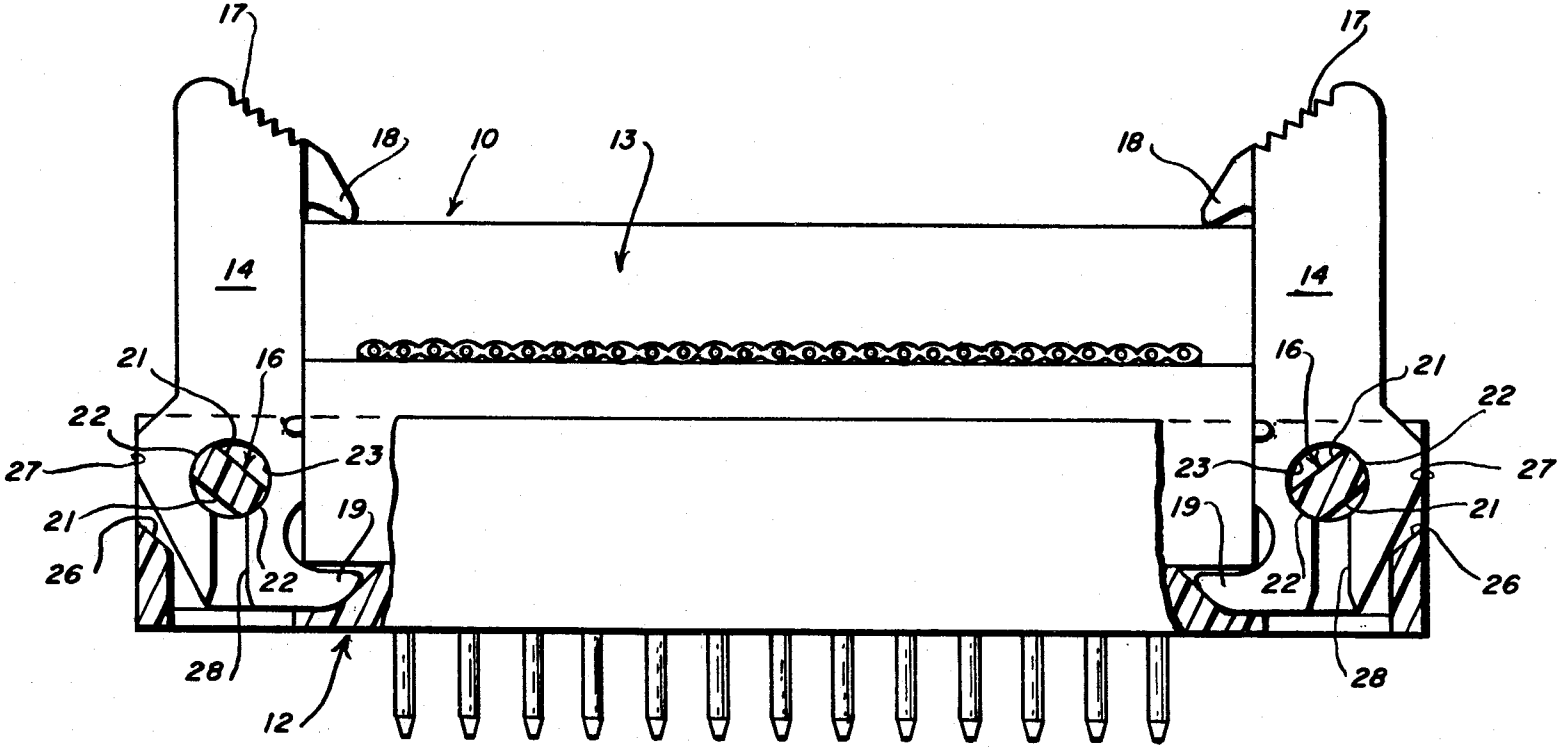
FIG. 1 is a front view partially in section of an electrical connector having ejector latches.

FIG. 1 shows an electrical connector generally designated by the reference numeral 10. The connector comprises a pin cup 12 and a socket 13. Ejector latches 14 are mounted on pivot pins 16 on opposite ends of the pin cup 12 so as to be adjacent the ends of the socket 13. Each ejector latch 14 includes a friction surface 17, a latch hook 18, and an ejector foot 19. In the position shown, the latch hook 18 maintains the socket 13 fully mated with the pin cup 12 and the ejector feet 19 are positioned just below the lower surface of the socket 13.

The pivot pins 16 are integrally molded with the sides of the pin cup 12 and are formed with two straight sides 21 and two curved sides 22 with the thickness of the pin measured between the straight sides 21 being substantially less than the thickness of the pin measured between the curved sides 22. The curved sides 22 fit within a circular pivot cup 23 molded into the sides of the ejector latch 14 and form bearing surfaces on which the pivot cup 23 and the ejector latch 14 rotate.

Figure 2:
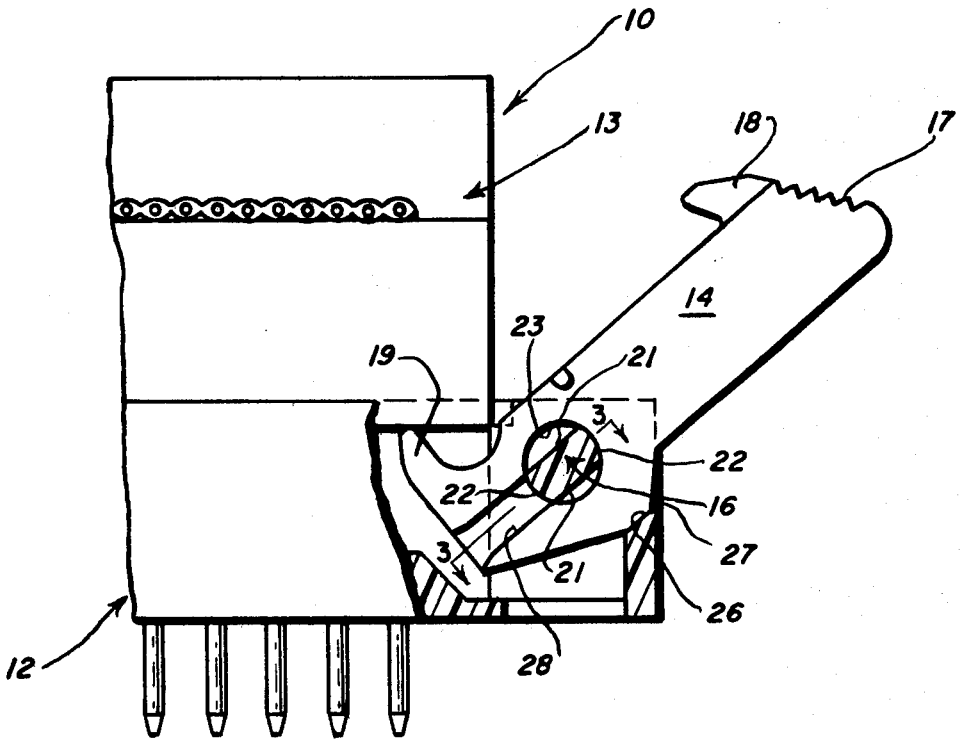
FIG. 2 is a partial sectional view of an ejector latch used to separate two halves of a connector.

As shown in FIG. 2, pressure on the friction surface 17 can be used to rock the ejector latch 14 on the pivot pins 16 causing the ejector foot 10 to lift the socket 13 from the pin cup 12. The rocking motion of the latch 14 is limited by a rest surface 26 on the pin cup 12 which contacts an abutment 27 on the rear of the ejector latch. In the position shown in FIG. 2, the flat sides 21 of the pivot pins 16 are aligned with an entry slot 28 formed in the side of the ejector latch 14, and it will be noted that the width of the entry slot 28 is sufficient to allow the pivot pins 16 in the given orientation to pass therethrough.

Figure 3:
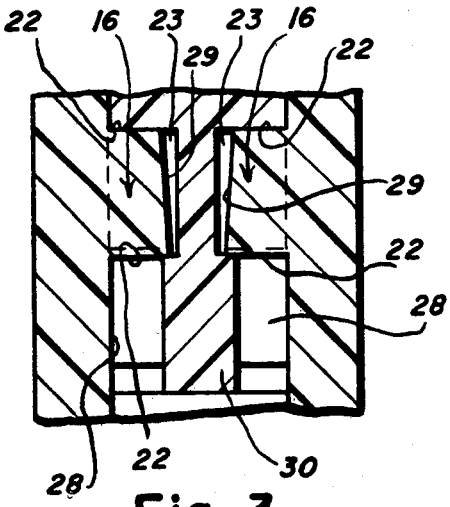
FIG. 3 is a sectional view taken along line 3—3 of FIG. 2 of a locking pivot connector for an ejector latch.

Turning now to FIG. 3, it will be seen that the depth of the pivot cups 23 is greater than the depth of the entry slots 28. The pivot pins 16 are formed with angled end faces 29 and the walls of the pin cup 12 adjacent the pivot pins 16 are sufficiently flexible to allow the neck of material 30 between the entry slots 28 to push past the angled end faces 29 as the ejector latches are being mounted on the connector. The extra depth of the pivot cups 23 accommodates the pivot pins 16 to provide a means for preventing accidental displacement of the ejector latch 14 from its mounted position.

Figure 4:
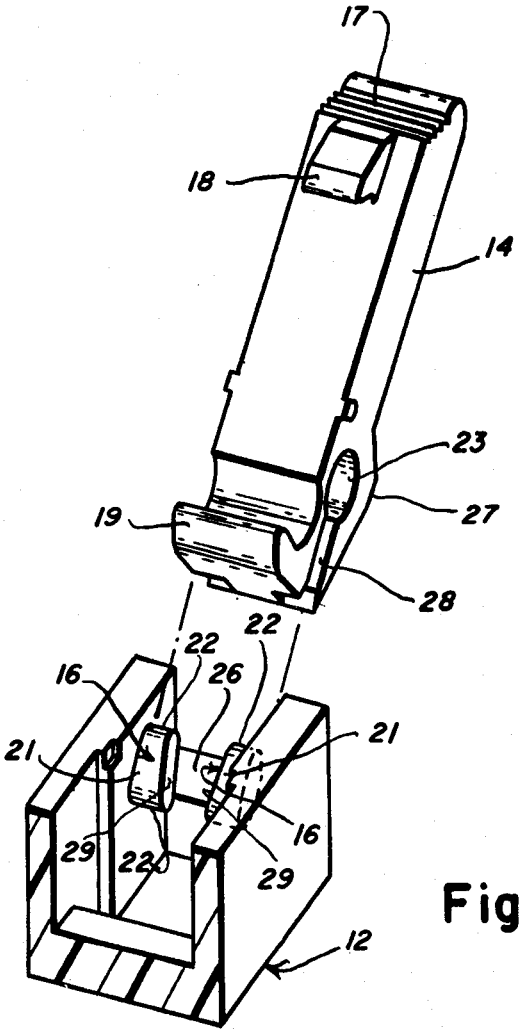
FIG. 4 shows an ejector latch seperated from the pin cup portion of a connector.

FIG. 4 shows the ejector latch 14 prior to mounting on the pivot pins 16. The latch is mounted onto the pin cup 12 by guiding the entry slots 28 onto the pivot pins 16.

The angled end faces 29 of the pivot pins allow the pivot pins to ride through the entry slots 28 until the pivot pins 16 snap into the pivot cup 23.

What is claimed is:

1. A locking pivot connection for a removable ejector latch for an electrical connector, wherein the electrical connector comprises a pin cup and a socket, said pin cup having opposite ends for mounting a pair of ejector latches, said locking pivot connecting comprising a pair of opposed pivot pins located on the end of said pin cup, each pivot pin comprising two opposite flat sides and two opposite curved sides, the thickness of said pivot pin measured between said flat sides being less than the thickness of said pivot pin measured between said curved sides, said locking pivot connection further comprising a pair of pivot cups located on opposite sides of said ejector latch, said pivot cups being circular and having a diameter slightly larger than the thickness of said pivot pin measured between the curved sides of said pivot pin, and a pair of entry slots on opposite sides of said ejector latch, said entry slots joining an outer edge of the ejector latch with a pivot cup and defining a neck of material therebetween, said entry slots having a width slightly larger than the thickness of the pivot pin measured between the flat sides of said pivot pin, whereby said ejector latch may slide onto said pivot pins in a direction generally parallel to the plane of the flat sides of said pivot pins and whereby said ejector latch may be locked onto said pivot pins by rotating said latch to skew said entry slots relative to said flat sides.

2. The locking pivot connection of claim 1 further comprising:

angled end faces on said pivot pins, said angled end faces allowing said pivot pins to enter said entry slots although the distance separating at least certain portions of said opposed pivot pins is less than the thickness of the neck of material between the entry slots on said ejector latch.

3. The locking pivot connection of claim 1 wherein said pivot cups have a depth which is greater than the depth of said entry slots.

4. The locking pivot connection of claim 2 wherein the walls of said connector on which said pivot pins are mounted are sufficiently flexible to allow said pivot pin end faces to spread outwardly to allow passage of said neck of material therethrough.

5. The locking pivot connection of claim 4 wherin said pivot cups have a depth which is greater than the depth of said entry slots, and futher, wherein said pivot cup depth is sufficient to accommodate said pivot pins, said pivot pins snapping into said pivot cups under the influence of said flexible connector walls.

* * * * *